US005736731A

United States Patent [19]

Kyushima et al.

[11] Patent Number: 5,736,731

[45] Date of Patent: Apr. 7, 1998

[54] PHOTOMULTIPLIER TUBE COMPRISING A SECOND DYNODE HAVING A SATURATED SECONDARY ELECTRON EMISSION RATIO

[75] Inventors: Hiroyuki Kyushima; Takayuki Omura; Kimitsugu Nakamura; Suenori Kimura; Yousuke Oohashi; Masuo Ito, all of Hamamatsu, Japan

[73] Assignee: Hamamatsu Photonics K.K., Shizuoka-ken, Japan

[21] Appl. No.: 684,140

[22] Filed: Jul. 19, 1996

[30] Foreign Application Priority Data

Jul. 20, 1995 [JP] Japan ..... 7-184022

[51] Int. Cl.[6] ..... H01J 43/18

[52] U.S. Cl. ..... 250/207; 313/533; 313/103 R

[58] Field of Search ..... 250/207, 214 VT, 250/216; 313/528, 530, 532, 533, 534, 535, 536, 103 R, 104, 105 R, 105 CM

[56] References Cited

U.S. PATENT DOCUMENTS

| | | | |
|---|---|---|---|
| 4,347,458 | 8/1982 | Tomasetti et al. | 313/103 R |
| 4,980,604 | 12/1990 | L'hermite | 313/533 |
| 5,264,693 | 11/1993 | Shimabukuro et al. | 250/207 |
| 5,438,191 | 8/1995 | Kimura et al. | 250/207 |
| 5,446,275 | 8/1995 | Sakai et al. | 250/207 |
| 5,525,794 | 6/1996 | Gibbons | 250/207 |
| 5,578,891 | 11/1996 | Sakai et al. | 313/103 R |
| 5,616,987 | 4/1997 | Ohmura et al. | 313/533 |
| 5,623,182 | 4/1997 | Okano et al. | 313/532 |
| 5,633,562 | 5/1997 | Okano et al. | 313/532 |
| 5,654,536 | 8/1997 | Suyama et al. | 250/207 |

FOREIGN PATENT DOCUMENTS

| | | | |
|---|---|---|---|
| 58-41620 | 9/1983 | Japan | H01J 43/20 |
| 58-41622 | 9/1983 | Japan | H01J 43/26 |
| 233840 | 2/1990 | Japan | H01J 31/50 |
| 233847 | 2/1990 | Japan | H01J 40/04 |
| 5114384 | 5/1993 | Japan | H01J 43/06 |

*Primary Examiner*—Edward P. Westin
*Assistant Examiner*—John R. Lee
*Attorney, Agent, or Firm*—Sugrue, Mion, Zinn, Macpeak & Seas, PLLC

[57] ABSTRACT

In a photomultiplier tube, a second dynode Dy2 is located in confrontation with a first dynode Dy1 in an electron multiplication portion 6. The second dynode Dy2 is made of material that has a secondary electron emission gain which is substantially saturated with respect to an electric voltage applied thereto.

13 Claims, 4 Drawing Sheets

V—δ CURVES OF SB AND SUS

PHOTOMULTIPLIER TUBE COMPRISING A SECOND DYNODE HAVING A SATURATED SECONDARY ELECTRON EMISSION RATIO

BACKGROUND OF THE INVENTION

1. Field of the Invention

The present invention relates to a photomultiplier tube for converting an incident light into photoelectrons and for multiplying the photoelectrons by a series of dynodes.

2. Description of the Related Art

A photomultiplier tube is used for receiving an incident light and for producing an amplified electric signal indicative of the incident light. In the photomultiplier tube, an electron multiplication portion is provided between a photocathode and an anode. The electron multiplication portion includes an array of successively disposed dynodes. When light is irradiated on the photocathode, the photocathode emits photoelectrons. When the photoelectrons impinge on a first dynode in the array, the first dynode emits secondary electrons, which impinge on a second dynode, which further emits secondary electrons, and so on. In this way, electrons are successively multiplied by the series of dynodes. The electrons will then be finally collected by the anode and be outputted as an amplified current signal.

Conventionally, various types of photomultiplier tubes have been proposed. However, conventional photomultiplier tubes have an insufficient TTS (Transit Time Spread). That is, the time duration taken by electrons to travel in conventional photomultiplier tubes is widely distributed. Accordingly, when the photomultiplier tube is operated in a pulse detection mode to detect a laser pulse, the electron multiplier tube will often output a small pre-pulse immediately before outputting a main pulse indicative of the received laser pulse.

SUMMARY OF THE INVENTION

It can be theorized that a photomultiplier tube generates a pre-pulse and a main pulse in a manner as described below.

FIG. 1 shows a structure of a conceivable photomultiplier tube 100. As shown in the drawing, when a light pulse falls incident on the photomultiplier tube 100, almost all of the light pulse is converted by the photocathode 101 into photoelectrons. Thus generated photoelectrons travel along a path "a" to impinge on a first dynode (referred to as Dy1 hereinafter.) When the photomultiplier tube 100 has a diameter of 8 inches, for example, the electrons take about 21 nsec to travel from the photocathode 101 to the first dynode Dy1. The electrons impinge on the first dynode Dy1, which generates secondary electrons as a result. The secondary electrons will be successively multiplied in an electron multiplication portion 102 by a second dynode Dy2, a third dynode Dy3, and so on, before being collected at an anode 103. Thus multiplied electrons will be outputted from the anode 103 as a main pulse.

A small part of the light pulse, however, passes through the photocathode 101. The light, i.e., photons, take about 0.44 nsec to linearly travel along another path "b" from the photocathode 101 to the first dynode Dy1. The photons impinge on the first dynode Dy1, which generates secondary electrons as a result. In a similar manner as described above, the secondary electrons will be successively multiplied in the electron multiplication portion 102 before outputting as a pre-pulse. The thus produced pre-pulse will appear about 20.56 nsec prior to the main pulse.

Based on the above-described theory, the present inventors made a photomultiplier tube as shown in FIG. 1 and provided a light shield over the photocathode 101 for preventing any photons from passing through the photocathode 101. The photomultiplier tube provided with the light shield, however, failed to suppress generation of the pre-pulse.

An object of the present invention is therefore to determine how a pre-pulse is generated in a photomultiplier tube and to provide an improved photomultiplier tube which is capable of suppressing the generation of a pre-pulse.

In order to attain the object and other objects, the present invention provides a photomultiplier tube comprising: a photocathode for emitting photoelectrons upon receiving incident light; and an electron multiplication portion for multiplying photoelectrons supplied from the photocathode in a cascade manner, the electron multiplication portion including: a first dynode for receiving photoelectrons supplied from the photocathode; and a second dynode for receiving electrons supplied from the first dynode, the second dynode having a secondary electron emission ratio which is substantially saturated with respect to an electric voltage applied thereto.

The second dynode may preferably have a secondary electron emission ratio which is substantially fixed with respect to electrons that are originated from the first dynode and with respect to other electrons that are reflected off the first dynode.

The first dynode may be applied with a first electric voltage, and the second dynode may be applied with a second electric voltage higher than the first electric voltage. The second dynode may have a secondary electron emission ratio which is substantially fixed with respect to an incident electron energy at least in the range of a difference between the first and second electric voltages and the second electric voltage.

According to another aspect, the present invention provides a photomultiplier tube comprising: a photocathode for emitting photoelectrons upon receiving incident light; and an electron multiplication portion for multiplying photoelectrons supplied from the photocathode in a cascade manner, the electron multiplication portion including: a first dynode for receiving photoelectrons supplied from the photocathode; and a second dynode for receiving electrons supplied from the first dynode, the second dynode having a secondary electron emission ratio which is substantially fixed with respect to electrons that are originated from the first dynode and other electrons that are reflected off the first dynode.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE INVENTION

The present inventors have further researched the photomultiplier tube of FIG. 1 in the manner described below, and have discovered that the pre-pulse is generated from photoelectrons that perform elastic scattering at the first dynode and then fall incident on the second dynode.

Figure 1:
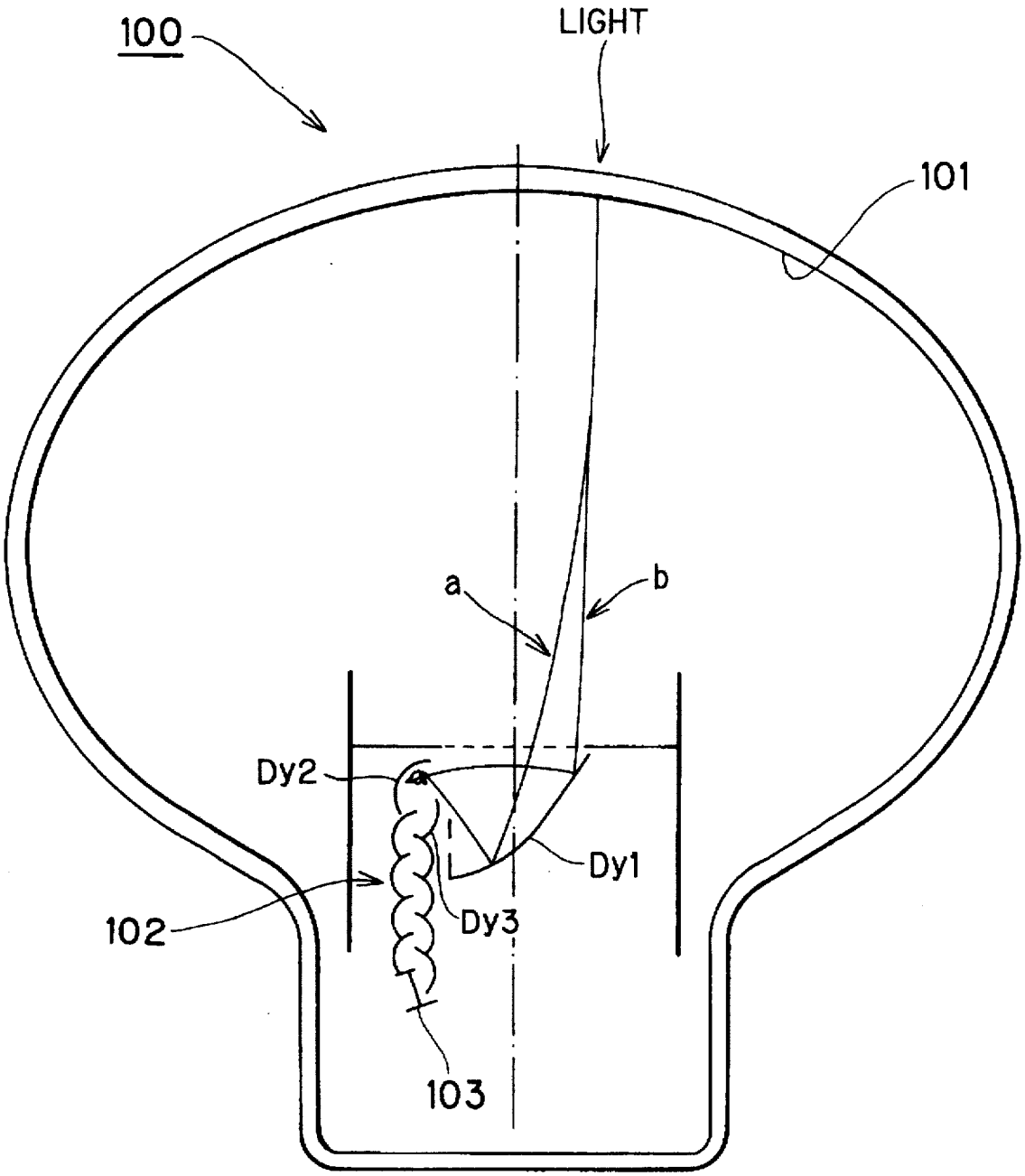
FIG. 1 schematically illustrates a theory as to how a pre-pulse is Generated in a photomultiplier tube.

The present inventors therefore made the photomultiplier tube 100 shown in FIG. 1. This photomultiplier tube 100 had the diameter of 8 inches. The photocathode 101 was covered with no light shields. The photomultiplier tube 100 was operated to be capable of detecting a single photon event. In other words, the number of photons incident on the photomultiplier tube 100 was adjusted so that the photocathode 101 generated one photoelectron at a time. A measuring system was arranged to measure a Transit Time Spread (TTS) of the photomultiplier tube 100. The measuring system therefore measured distribution in time duration taken by electrons to travel in the photomultiplier tube 100.

A pre-pulse was observed about once while a main pulse was observed a hundred times. In other words, the probability of observing the pre-pulse was about 1/100. The pre-pulse was observed about 5 to 6 nsec before the main pulse. It can therefore be estimated that this pre-pulse was produced by electrons that reach the anode 103 about 5 to 6 nsec before other electrons that form the main pulse.

Next, the number of photons incident on the photomultiplier tube 100 was increased so that the photocathode 101 generated about 40 photons at a time. Under this condition, the pre-pulse was observed about 40 times while the main pulse was observed 100 times. The probability of observing the pre-pulse was therefore increased up to about 40/100. It is therefore apparent that the number of electrons that form the pre-pulse increased substantially in proportion to the number of incident photons.

If the pre-pulse had been a part of the main pulse, even when the number of incident photons increased, the probability of observing the pre-pulse would not have changed. It can therefore be concluded that the pre-pulse is not a part of the main pulse.

If, on the other hand, the pre-pulse had been produced by photons that pass through the photocathode 101 as described already, the pre-pulse should have been observed about 20.56 nsec before the main pulse. It can therefore be concluded that the pre-pulse is not produced by those photons, either.

The present inventors have therefore estimated that some of the photoelectrons emitted from the photocathode 101 perform elastic collision against the first dynode Dy1. These photoelectrons merely reflect off the first dynode Dy1 and travel to the second dynode Dy2, without generating secondary electrons at the first dynode Dy1. When the photoelectrons enter the second dynode Dy2, however, the second dynode Dy2 generates secondary electrons. The secondary electrons are then multiplied by the successive dynodes before being collected by the anode 103 as a pre-pulse. This theory is confirmed in items (1) through (3) described below.

(1) This theory agrees with the observed time difference of 5 nsec between the pre-pulse and the main pulse.

An electron forming the main pulse will reach the third dynode Dy3 32 nsec after the photocathode 101 emits the original photoelectron. That is, a photoelectron takes 21 nsec to travel from the photocathode 101 to the first dynode Dy1. A secondary electron emitted from the first dynode Dy1 takes 8 nsec to travel from the first dynode Dy1 to the second dynode Dy2. A secondary electron emitted from the second dynode Dy2 takes 3 nsec to travel from the second dynode Dy2 to the third dynode Dy3.

On the other hand, when a photoelectron emitted from the photocathode 101 performs elastic collision against the first dynode Dy1, the photoelectron reflects off the first dynode Dy1 and travels to the second dynode Dy2. The photoelectron separates from the first dynode Dy1 driven by its incident speed. Accordingly, the photoelectron reflected from the first dynode Dy1 takes only 3 nsec to travel from the first dynode Dy1 to the second dynode Dy2. Travel times from the photocathode 101 to the first dynode Dy1 and from the second dynode Dy2 to the third dynode Dy3 are the same. Accordingly, an electron that forms a pre-pulse will reach the third dynode Dy3 27 nsec after the photocathode 101 emits the original photoelectron.

It is therefore proven that the pre-pulse is observed 5 nsec before the main pulse.

(2) This theory also proves that probability of observing the pre-pulse increases as the number of incident photons increases.

Generally, about 10% of all the electrons incident on the first dynode Dy1 perform elastic collision against the first dynode Dy1. Also about 10% of electrons that reflect from the first dynode Dy1 will actually enter the second dynode Dy2. In terms of a single photon event, the probability that a reflected electron will reach the second dynode Dy2 is about 1/100. This value is consistent with observations of single photon events.

As the number of incident photons increases, the total number of photoelectrons emitted from the photocathode 101 increases. Accordingly, the number of electrons, that reflect at the first dynode Dy1, also increases. This proves that the probability of observing the pre-pulse increases when the number of photons incident on the photomultiplier tube increases.

(3) The present inventors performed another experiment where the present inventors increased a lower level discrimination level (LLD) up to a value equal to the main pulse charge. As a result, the pre-pulse was not observed. This measurement result shows that the pre-pulse charge is lower than the main pulse charge. This measured result also agrees with this theory as described below.

When a photoelectron reflects off the first dynode Dy1 and travels to the second dynode Dy2, the photoelectron fails to be multiplied at the first dynode Dy1. Accordingly, the pre-pulse produced from this reflected photoelectron has a lower charge than does the main pulse.

As described above, the present inventors' theory is consistent with the results measured for all the parameters: the electron travelling time durations, the pre-pulse observing probability, and the pre-pulse amount. Accordingly, it can be concluded that the pre-pulse is produced by photoelectrons that reflect at the first dynode Dy1.

According to the present invention, therefore, in order to suppress the influence from the thus-reflected photoelectrons, the second dynode Dy2 is made of a material having a secondary electron emission ratio which becomes substantially saturated with regard to an electric voltage applied thereto. Generally, when a dynode receives an electron having a large energy, the dynode will emit a large number of secondary electrons. In other words, as the energy possessed by the incident electron increases, the secondary electron emission ratio of the dynode also increases. When a dynode has a saturated secondary electron emission ratio, however, even when the dynode receives a large-energy electron, the secondary electron emission ratio will not greatly increase compared to when the dynode receives a small-energy electron.

It is noted that photoelectrons that reflect from the first dynode Dy1 have been accelerated by an electric potential difference developed between the photocathode 101 and the first dynode Dy1. Accordingly, those photoelectrons have a larger energy or velocity than secondary electrons emitted or originated from the first dynode Dy1. According to the present invention, because the second dynode Dy2 has a saturated secondary electron emission ratio with regard to the incident electrons, even though the second dynode Dy2 receives the photoelectrons that reflect from the first dynode Dy1, the second dynode Dy2 will not emit secondary electrons with a largely-increased emission ratio. It is therefore possible to suppress influence from the reflected photoelectrons and thereby to decrease the intensity of the pre-pulse.

Representative examples of the material having the saturated secondary electron emission ratio include: aluminum (Al), copper (Cu), beryllium (Be), nickel (Ni), iron (Fe), molybdenum (Mo), tungsten (W), and stainless steel. The second dynode Dy2 is therefore preferably made of any one of the materials.

The second dynode Dy2 may preferably be made of a conductive substrate covered with a film made of any one of aluminum (Al), carbon (C), chromium (Cr), iron (Fe), zinc (Zn), nickel (Ni), and tungsten (W). Those films may be provided on the substrate through a vacuum evaporation method.

The first and second dynodes may preferably be applied with electric voltages so that an electric potential difference of 200 volts or more is developed between the first and second dynodes.

When the electric potential between the first and second dynodes is increased to 200 volts or more, it is possible to shorten the time duration taken by secondary electrons emitted from the first dynode to travel from the first dynode to the second dynode. It is therefore possible to shorten the difference between the time duration taken by the secondary electrons to travel between the first and second dynodes and the time duration taken by photoelectrons, that perform elastic collision at the first dynode, to travel between the first and second dynodes.

Next will be described a preferred embodiment of a photomultiplier tube of the present invention while referring to FIGS. 2 through 4 wherein like parts and components are designated by the same reference numerals.

Figure 2:
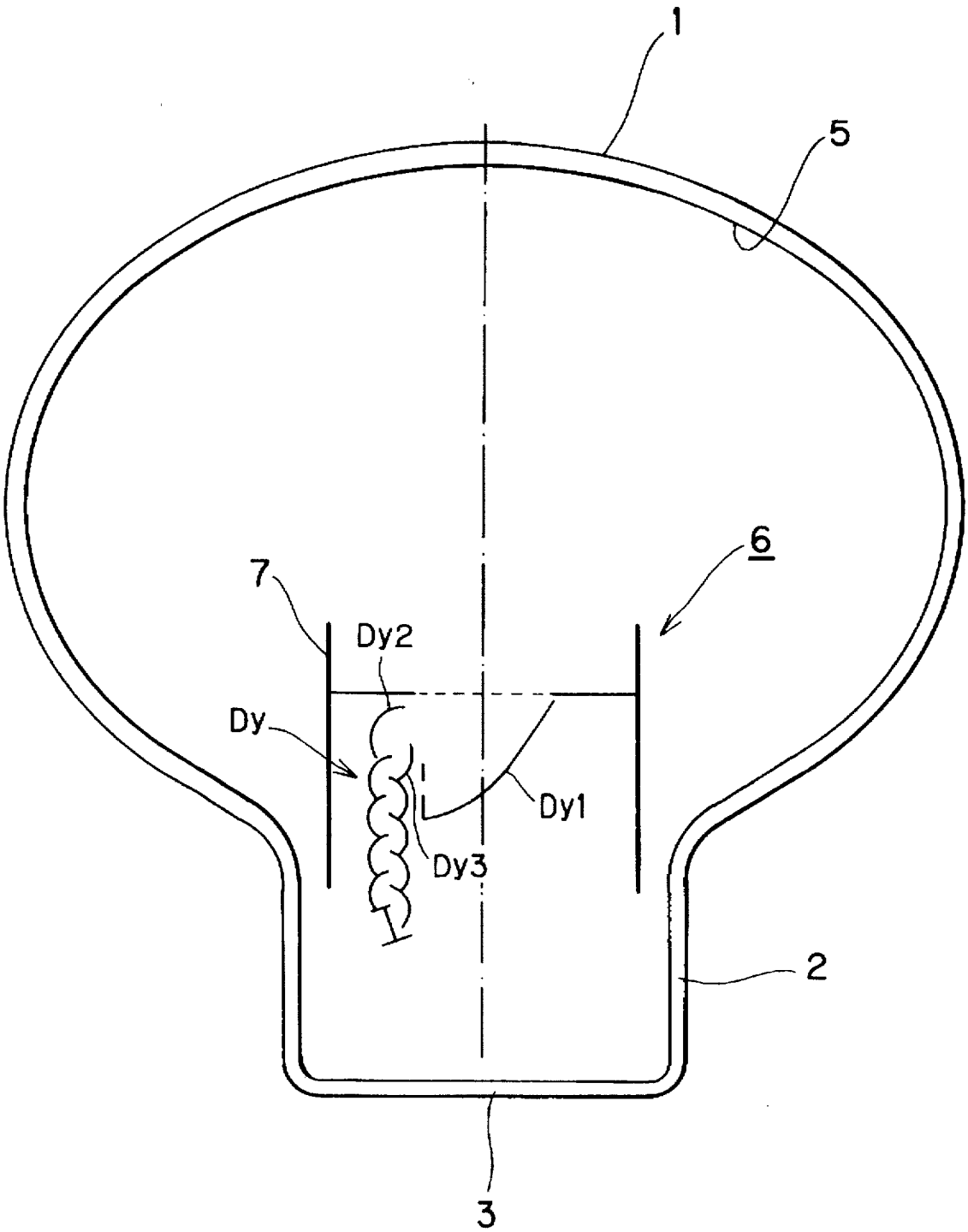
FIG. 2 schematically shows a sectional view of a photomultiplier tube of an embodiment of the present invention.

FIG. 2 shows a photomultiplier tube of the preferred embodiment of the present invention.

The photomultiplier tube includes a vacuum chamber constructed from a substantially spherical light-receiving surface 1, a bulb portion 2, and a cylindrical stem portion 3 serving as a stand base. A photoelectric cathode 5 is formed on the inner surface of the light-receiving surface 1. Light incident on the light-receiving surface 1 is irradiated on the photoelectric cathode 5, whereupon photoelectrons are emitted from the photoelectric cathode 5. The photoelectric cathode 5 is applied with zero (0) volts. An electron multiplication portion 6 is provided in confrontation with the photocathode 5 for multiplying photoelectrons supplied from the photocathode 5.

Figure 3:
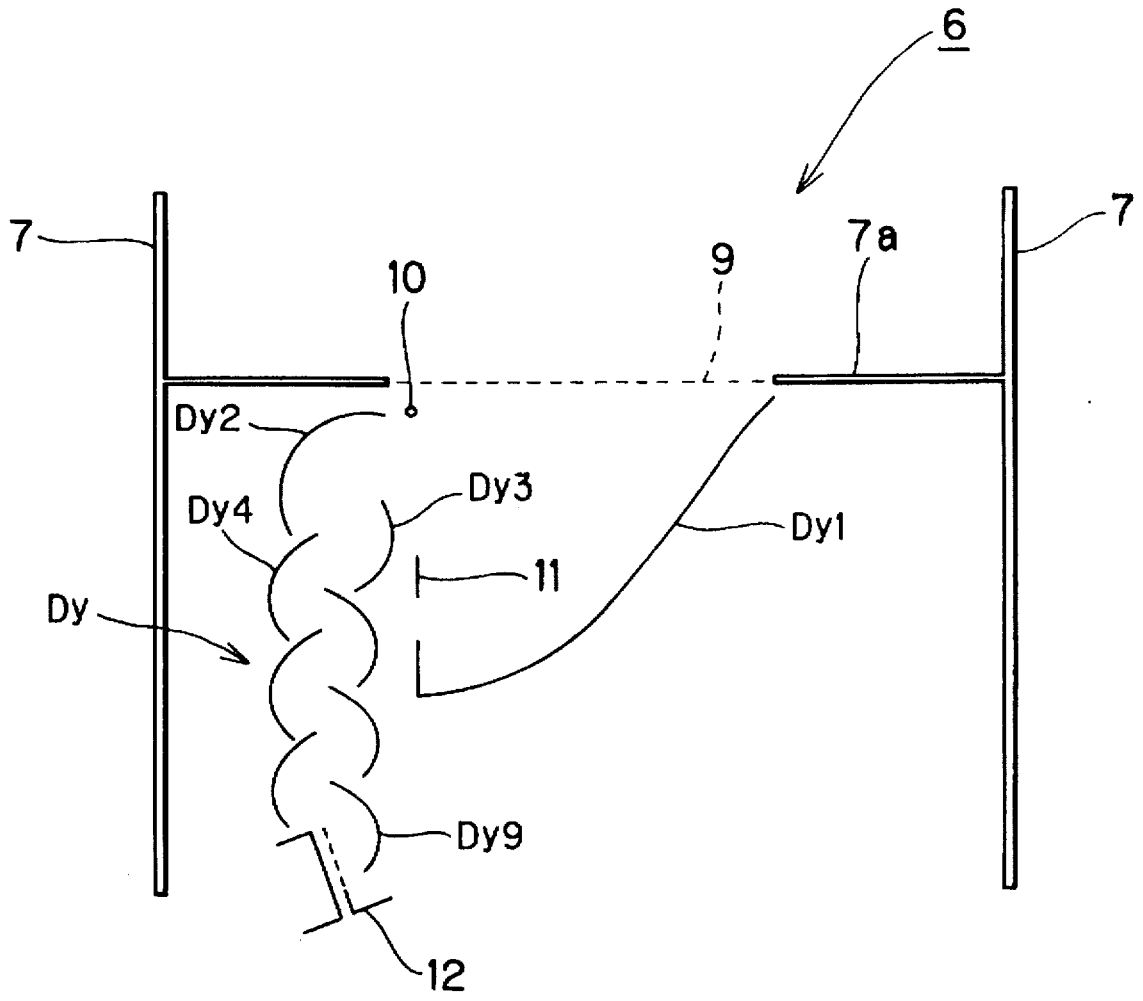
FIG. 3 is an enlarged view of an essential portion of the photomultiplier tube of FIG. 2.

FIG. 3 shows an enlarged view of the electron multiplication portion 6. The portion 6 is accommodated in a focus electrode 7 substantially of a rectangular parallelepiped shape. The electrode 7 is for shielding the electron multiplication portion 6 against influences from the potential of the photocathode 5. The rectangular parallelepiped electrode 7 is opened at its bottom portion facing the stem 3. The focus electrode 7 has an incident opening 7*a* at its top portion facing the photocathode 5. The incident opening 7*a* is covered with a mesh electrode 9. As shown in the drawing, walls protrude around the incident opening 7*a* in a direction toward the photocathode 5. The walls are for converging photoelectrons from the photocathode 5 toward the incident opening 7*a*. The focus electrode 7 and the mesh electrode 9 are connected and so applied with the same electric potential.

A first dynode Dy1, for receiving photoelectrons having passed through the incident opening 7*a* and for emitting secondary electrons accordingly, is provided in confrontation with the incident opening 7*a*. For example, the first dynode Dy1 is of a curved shape resembling a quarter section of a cylinder. A dynode group Dy is provided in confrontation with the first dynode Dy1.

The dynode group Dy includes second through ninth dynodes Dy2–Dy9 and an anode 12 which are arranged in a line-focused manner. The dynode group Dy is located so that the second dynode Dy2 confronts the first dynode Dy1.

A plate electrode 11 and a pole electrode 10 are additionally disposed between the first dynode Dy1 and the mesh electrode 9. Both the pole electrode 10 and the plate electrode 11 are provided extending in a direction perpendicular to the sheet of FIG. 3.

Each of the electrodes 9, 10, 11 and the dynodes Dy1 and Dy3 through Dy9 is made of a stainless steel material. Each of the dynodes Dy1 and Dy3 through Dy9 is formed with a secondary electron emission surface at its inner side. The secondary electron emission surface is constructed from an antimony (Sb) film formed through a vacuum evaporation process. The second dynode Dy2 is also made of a stainless steel material. However, the second dynode Dy2 includes no antimony film.

According to the present embodiment, the first and second dynodes Dy1 and Dy2 are applied with electric voltages so that an electric potential difference of 249 volts is developed therebetween. This electric potential is twice as high as the electric potential of 100 volts applied between first and second dynodes of general photomultiplier tubes. For example, the first dynode Dy1 is applied with 800 volts, and the second dynode Dy2 is applied with 1049 volts.

The focus electrode 7 and the mesh electrode 9 are applied with an electric voltage which is higher than the electric voltage applied to the first dynode Dy1. The pole electrode 10 and the plate electrode 11 are also applied with electric voltages which are higher than the electric voltage applied to the first dynode Dy1.

With the above-described structure, electrons reflected or emitted from the first dynode Dy1 are guided to the second dynode Dy2. Secondary electrons emitted from the second dynode Dy2 are guided to the third dynode Dy3. Thus, electrons are successively multiplied in a cascade manner by those dynodes before being collected at the anode 12.

Figure 4:
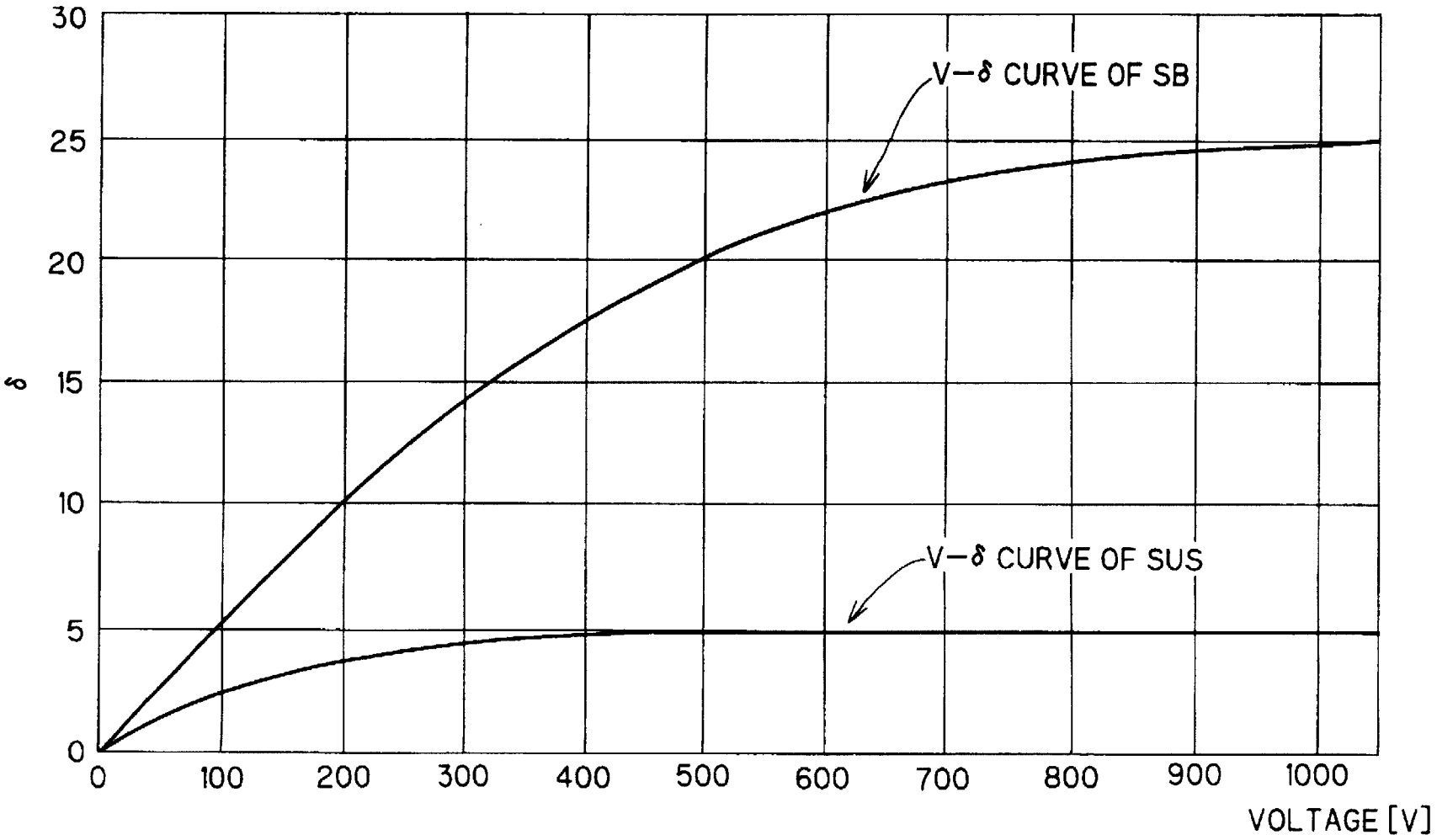
FIG. 4 is a graph showing a secondary electron emission ratio $\delta$ of a dynode relative to energy of an incident electron.

FIG. 4 is a graph indicative of secondary electron emission ratios δ of a general type of dynode made of a stainless steel covered with an antimony (Sb) film (referred to as an "Sb-covered dynode" hereinafter) and of a dynode made of a stainless steel covered with no films (referred to as a "non-covered SUS dynode" hereinafter.) The present embodiment employs the Sb-covered dynode for each of the dynodes Dy1 and Dy3 through Dy9, and employs the non-covered SUS dynode for the dynode Dy2. In this graph, the horizontal axis denotes energy possessed by an electron incident on the dynode, that is, an electron voltage [volts] with which the incident electron is energized before falling incident on the dynode. The vertical axis denotes a secondary electron emission ratio δ of each type of dynode. The secondary electron emission ratio δ indicates the number of secondary electrons that the dynode emits upon receiving one primary electron that has a certain amount of energy. A curve indicated by "V-δ curve of Sb" represents how the secondary electron emission ratio δ of the Sb-covered dynode changes according to the energy of the incident electrons. The other curve indicated by "V-δ curve of SUS" represents how the secondary electron emission ratio δ of the non-covered SUS dynode changes according to the energy of the incident electrons.

As apparent from the graph, the secondary electron emission ratio δ of the Sb-covered dynode gradually increases as the energy of the incident electron increases. Contrarily, the secondary electron emission ratio δ of the non-covered SUS dynode increases very little as the energy of the incident electron increases. The non-covered SUS dynode therefore presents a saturated secondary electron emission characteristic. Especially when the energy of the incident electron exceeds 400 electron volts, the secondary electron emission ratio δ will be fixed to the value of 5.

In the present embodiment, the non-covered SUS dynode is used as the second dynode Dy2. Accordingly, the secondary electron emission ratio δ increases very little even when the energy of the electron falling incident on the second dynode Dy2 increases.

Next will be described in greater detail advantages obtained by the photomultiplier tube of the present embodiment where the second dynode Dy2 is constructed from a dynode with a saturated secondary electron emission characteristic. The advantages will be described in comparison with a comparative example where the second dynode Dy2 is constructed from a general type of Sb-covered dynode.

A ratio of the number of electrons that form a pre-pulse compared to the number of electrons that form a main pulse is calculated for each of the photomultiplier tubes of the present embodiment and of a comparative example. This calculation is performed when the photomultiplier tube is operated to detect a single photon event and for the number of electrons that reach the third dynode Dy3.

It is now assumed that all the dynodes in the comparative example are constructed from the general type of Sb-covered dynodes. The first dynode Dy1 is applied with 800 volts, and the second dynode Dy2 is applied with 900 volts. It is apparent from FIG. 4 that upon receiving electrons of 800 electron voltage, the first dynode Dy1 will emit secondary electrons at a secondary electron emission ratio δ of 24. Because 100 (=900−800) volts are applied between the first and second dynodes Dy1 and Dy2. The second dynode Dy2 receives electrons of 100 electron voltages from the first dynode Dy1. The second dynode Dy2 therefore emits secondary electrons at a secondary electron emission ratio δ of 5. Accordingly, 120 (=24×5) electrons will reach the third dynode Dy3. Those electrons will form a main pulse.

Some of the electrons that are accelerated by the electric potential of 800 volts perform elastic scattering at the first dynode Dy1 and so do not emit secondary electrons. The reflected electrons are accelerated by the 900 volts applied to the second dynode Dy2. Receiving the electrons with 900 electron volts, the second dynode Dy2 emits secondary electrons at a secondary electron emission ratio δ of 24.5. These secondary electrons will reach the third dynode Dy3 to produce a pre-pulse.

Accordingly, the ratio of the number of pre-pulse forming electrons relative to the number of main pulse-forming electrons is calculated as 0.2 (≈24.5/120).

Next, the ratio of the number of pre-pulse forming electrons relative to the number of main pulse-forming electrons will be calculated for the photomultiplier tube of the present embodiment. In the photomultiplier tube, the second dynode Dy2 is constructed from the non-covered SUS dynode with a saturated secondary electron emission characteristic. In the embodiment, the first dynode Dy1 is applied with 800 volts, and the second dynode Dy2 is applied with 1049 volts. It is apparent from FIG. 4 that receiving electrons of 800 electron voltages, the first dynode Dy1 emits secondary electrons at a secondary electron emission ratio δ of 24. Because 249 volts are applied between the first and second dynodes Dy1 and Dy2, the second dynode Dy2 receives electrons of 249 electron volts, and emits secondary electrons at a secondary electron emission ratio δ of 4. Accordingly, the number of electrons that reach the third dynode Dy3 is 96 (=24×4). Those electrons will form a main pulse.

When the electrons accelerated by the electric voltages of 800 volts perform elastic scattering at the first dynode Dy1, however, the electrons are further accelerated by the electric voltage of 1049 volts applied to the second dynode Dy2. Receiving the electrons of 1049 electron volts, the second dynode Dy2 will emit secondary electrons at a secondary electron emission ratio δ of 5. These electrons will reach the third dynode Dy3 and form a pre-pulse. Accordingly, the ratio of the number of pre-pulse forming electrons relative to the number of main pulse forming electrons is calculated as 0.05 (≈5/96).

The above-described calculation results show that when the second dynode Dy2 is constructed from a dynode with a saturated secondary electron emission ratio, even though the LLD is set to a zero value, the pre-pulse measured for the single photon event will be decreased as small as ¼ (=0.05/0.2) of a value measured by conventional photomultiplier tubes.

In conventional photomultiplier tubes, in order to remove a pre-pulse, LLD has to be set equal to or greater than 20% of the main pulse intensity. Contrarily, according to the photomultiplier tube of the present invention, the pre-pulse can be sufficiently removed by setting the LLD as small as 10% of the main pulse intensity. This is because the ratio of the pre-pulse intensity relative to the main pulse intensity is only 0.05. Through decreasing the LLD of the photomultiplier tube, it is possible to detect a smaller amount of light even when the photomultiplier tube is used for detection in a wide range from a single photon level to several hundred photon level. Because the pre-pulse intensity is about one several hundredth of the main pulse intensity, even when the number of photons incident on the photocathode increases, TTS will decrease in terms of $1/N^{0.5}$ (where N indicates the number of photons) and will not increase.

It is noted that the pre-pulse can be sufficiently suppressed when the second dynode Dy2 presents almost the same secondary electron emission ratio with respect to electrons (secondary electrons) emitted or originated from the first dynode Dy1 and with respect to electrons (photoelectrons) reflected from the first dynode Dy1. When falling incident on the second dynode Dy2, electrons emitted or originated from the first dynode Dy1 has an energy E1 which is defined as a difference between electric potentials V1 and V2 developed to the first and second dynodes Dy1 and Dy2. When falling incident on the second dynode Dy2, electrons reflected from the first dynode Dy1 has an energy E2 defined as the electric potential V2 applied to the second dynode Dy2. Accordingly, the pre-pulse can be sufficiently suppressed when the second dynode Dy2 has an almost fixed or unchanged emission ratio with regards to the incident electron energy at least in the range from E1 (=V2−V1) to E2 (=V2). In the above-described example, the first dynode Dy1 is applied with 800 volts and the second dynode Dy2 is applied with 1049 volts. The pre-pulse is sufficiently suppressed because the non-covered SUS (second dynode Dy2) presents, as shown in FIG. 4, an almost saturated emission ratio with respect to the incident electron energy in the range from 249 electron volts to 1049 electron volts.

According to the photomultiplier tube of the present embodiment, an electric potential difference of 200 volts or more is developed between the first dynode Dy1 and the second dynode Dy2. This electric potential difference is greater than a value twice as high as electric potential differences developed between first and second dynodes in the conventional photomultiplier tubes. Accordingly, the time durations taken by secondary electrons emitted from the first dynode Dy1 to travel between the first and second dynodes can be shortened. It becomes possible to decrease the difference between this secondary electron travelling time duration and a time duration taken by photoelectrons, which perform elastic scattering at the first dynode Dy1, to travel between the first and second dynodes. Accordingly, a distribution of electron travelling time durations can be decreased.

In the above-described embodiment, the second dynode Dy2 is made of a stainless steel material. Any kinds of stainless steel can be used for constructing the second dynode Dy2 because those stainless steels present substantially the same characteristics. Metal materials of aluminum (Al), copper (Cu), beryllium (Be), nickel (Ni), iron (Fe), molybdenum (Mo), and tungsten (W) present the secondary electron emission ratio curves δ substantially the same as that of the stainless steel shown in FIG. 4. Accordingly, the same advantages can be obtained when the second dynode is made of those metal materials.

The second dynode Dy2 may be constructed from a conductive substrate covered with a metal film of either one of the materials aluminum (Al), carbon (C), chromium (Cr), iron (Fe), zinc (Zn), nickel (Ni), and tungsten (W). The film may be formed through a vacuum evaporation method. This dynode also presents the secondary electron emission ratio curve substantially the same as that of the stainless of FIG. 4.

Dynodes other than the second dynode can be constructed from semiconductor dynodes. For example, secondary emission surfaces of these dynodes can be made of semiconductor such as GaAs, GaIn, and the like.

As described above, according to the photomultiplier tube of the present invention, the second dynode presents a substantially-saturated secondary electron emission ratio. Accordingly, even when the second dynode is incident with electrons having largely varying energies, the second dynode will emit secondary electrons at almost a uniform secondary electron emission ratio. It therefore becomes possible to suppress a pre-pulse which is produced by electrons that perform elastic scattering at the first dynode and enter the second dynode with a large energy.

While the invention has been described in detail with reference to the specific embodiment thereof, it would be apparent to those skilled in the art that various changes and modifications may be made therein without departing from the spirit of the invention.

What is claimed is:

1. A photomultiplier tube comprising:

a photocathode for emitting photoelectrons upon receiving incident light; and an electron multiplication portion for multiplying photoelectrons supplied from the photocathode in a cascade manner, the electron multiplication portion including:

a first dynode for receiving photoelectrons supplied from the photocathode; and a second dynode for receiving electrons supplied from the first dynode, the second dynode having a secondary electron emission ratio which is substantially saturated with respect to an electric voltage applied thereto.

2. A photomultiplier tube of claim 1, wherein the second dynode is made from a material selected from a group consisting of aluminum, copper, beryllium, nickel, iron, molybdenum, tungsten, and a stainless steel.

3. A photomultiplier tube of claim 1, wherein the second dynode is made of a conductive substrate covered with a material selected from a group consisting of aluminum, carbon, chromium, iron, zinc, nickel, and tungsten.

4. A photomultiplier tube of claim 1, wherein the first dynode is made of a stainless steel covered with an antimony film which is provided over the stainless steel through a vacuum evaporation, and the second dynode is made of a stainless steel covered with no film.

5. A photomultiplier tube of claim 1, wherein the first and second dynodes are applied with electric voltages with an electric potential difference developed therebetween having a value equal to or higher than 200 volts.

6. A photomultiplier tube of claim 1, further comprising an anode for collecting electrons multiplied in the electron multiplication portion.

7. A photomultiplier tube of claim 1, wherein the second dynode has a secondary electron emission ratio which is substantially fixed with respect to electrons that are originated from the first dynode and with respect to other electrons that are reflected off the first dynode.

8. A photomultiplier tube of claim 7, wherein the first dynode is applied with a first electric voltage, and the second dynode is applied with a second electric voltage higher than the first electric voltage, the second dynode having a secondary electron emission ratio which is substantially fixed with respect to an incident electron energy at least in the range of a difference between the first and second electric voltages and the second electric voltage.

9. A photomultiplier tube comprising:

a photocathode for emitting photoelectrons upon receiving incident light; and an electron multiplication portion for multiplying photoelectrons supplied from the photocathode in a cascade manner, the electron multiplication portion including:

a first dynode for receiving photoelectrons supplied from the photocathode; and a second dynode for receiving electrons supplied from the first dynode, the second dynode having a secondary electron emission ratio which is substantially fixed with respect to electrons that are originated from the first dynode and other electrons that are reflected off the first dynode.

10. A photomultiplier tube of claim 9, wherein the first dynode is applied with a first electric voltage, and the second dynode is applied with a second electric voltage higher than the first electric voltage, the second dynode having a secondary electron emission ratio which is substantially fixed with respect to an incident electron energy in the range of a difference between the first and second electric voltages and the second electric voltage.

11. A photomultiplier tube of claim 9, wherein the second dynode is made from a material selected from a group consisting of aluminum, copper, beryllium, nickel, iron, molybdenum, tungsten, and a stainless steel.

12. A photomultiplier tube of claim 9, wherein the second dynode is made of a conductive substrate covered with a material selected from a group consisting of aluminum, carbon, chromium, iron, zinc, nickel, and tungsten.

13. A photomultiplier tube of claim 9, wherein the first dynode is made of a stainless steel covered with an antimony film which is provided over the stainless steel through a vacuum evaporation, and the second dynode is made of a stainless steel covered with no film.

* * * * *